313-414
8/19/86 OR 4,607,187 SR

United States Patent [19]

Villanyi

[11] Patent Number: 4,607,187

[45] Date of Patent: Aug. 19, 1986

[54] STRUCTURE FOR AND METHOD OF ALIGNING BEAM-DEFINING APERTURES BY MEANS OF ALIGNMENT APERTURES

[75] Inventor: Sigmund T. Villanyi, Lancaster Township, Lancaster County, Pa.

[73] Assignee: RCA Corporation, Princeton, N.J.

[21] Appl. No.: 643,314

[22] Filed: Aug. 22, 1984

[51] Int. Cl.[4] ..... H01J 29/46; H01J 29/50

[52] U.S. Cl. ..... 313/414; 313/447; 445/34

[58] Field of Search ..... 313/409, 414, 417, 444, 313/446, 447, 448, 456, 457; 445/34, 36, 67

[56] References Cited

U.S. PATENT DOCUMENTS

| | | | |
|---|---|---|---|
| 2,436,264 | 2/1948 | O'Larte et al. | 445/34 X |
| 2,732,512 | 1/1956 | Briggs, Jr. | 313/446 |
| 2,859,371 | 11/1958 | Watson et al. | 313/244 |
| 3,396,297 | 8/1968 | Burdick | 313/70 |
| 3,500,520 | 3/1970 | Oess | 29/25.16 |
| 3,507,020 | 4/1970 | Aiken | 29/25.16 |
| 3,524,235 | 8/1970 | Burdick | 29/25.16 |
| 3,530,560 | 9/1970 | Sawagata | 29/25.19 |
| 3,581,357 | 6/1971 | Oess | 29/25.16 |
| 3,604,973 | 9/1971 | Doggett et al. | 313/260 |
| 3,643,121 | 2/1972 | Sawagata et al. | 313/70 |
| 3,702,020 | 11/1972 | Say | 29/25.19 |
| 3,777,210 | 12/1973 | Spalding | 313/256 |
| 3,906,279 | 9/1975 | Linssen | 313/409 |
| 4,298,818 | 11/1981 | McCandless | 313/417 |
| 4,500,808 | 2/1985 | McCandless | 313/409 |

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

A multibeam electron gun comprises two spaced successive electrodes individually held in position from a common electrically-insulating support. Each of the electrodes has at least three beam-defining apertures therein. Each of the electrodes also has two dissimilarly shaped alignment apertures therein which are mutually aligned so that the beam defining apertures are accurately aligned along common axes in a statically determined manner.

5 Claims, 6 Drawing Figures

STRUCTURE FOR AND METHOD OF ALIGNING BEAM-DEFINING APERTURES BY MEANS OF ALIGNMENT APERTURES

BACKGROUND OF THE INVENTION

This invention relates to a novel multibeam electron gun having a cathode-grid subassembly and to a novel method for assembling that electron gun.

U.S. Pat. No. 4,298,818, issued to H. E. McCandless on Nov. 3, 1981, describes an electron gun for use in a multibeam cathode-ray tube. That gun includes at least two spaced successive electrodes held in position from a common support. Each electrode comprises a single metal plate having three beam-defining apertures therein, which apertures are so aligned as to permit the passage of three electron beams. The sizes and shapes of the electron beams are determined, in part, by the sizes, shapes and alignments of the apertures.

When there are three or more beam-defining apertures in each of two spaced single-plate electrodes, it is the practice to align the apertures of the electrodes, either optically or mechanically, from two of the beam-defining apertures of each of the electrodes. While the positioning of the apertures in each electrode are precisely prescribed, nevertheless there are necessary manufacturing tolerances present in the fabrication of these electrodes and in the alignment pins which maintain the alignment of the beam-defining apertures during a brazing operation.

U.S. Pat. No. 4,500,808 issued to H. E. McCandless on Feb. 19, 1985, describes an electron gun and method of assembly in which one of the electrodes is a composite structure comprising a support member and a plurality of plate members. The plate members, each of which has a single beam-defining second aperture, are separately aligned to one of the first apertures in the other electrode by means of alignment pins extending through each of the first and second beam-defining apertures. The plate members are brazed to the support member to maintain the precise alignment between the first and second apertures. The manufacturing cost of such a structure is relatively high, since a larger number of accurately dimensioned electron gun components are required than in the patented structure described in U.S. Pat. No. 4,298,818. Furthermore, it is desirable to avoid using alignment pins through the beam-defining apertures of the electron gun electrodes, since the pins may distort or scratch the material surrounding the apertures, thereby causing uncontrolled variations in electron beam size and shape.

A copending U.S. Pat. application Ser. No. 643,175, filed on Aug. 22, 1984, by H. E. McCandless et al., entitled, "MULTIBEAM ELECTRON GUN HAVING A CATHODE-GRID SUBASSEMBLY AND METHOD OF ASSEMBLING THE SAME", discloses a structure and method for indirectly aligning the beam-defining apertures of an electron gun by means of a pair of substantially identical alignment apertures. The screen grid electrode in the structure described in the copending application is also a composite structure; however, the number of screen grid electrode components have been reduced from four, as described in U.S. Pat. No. 4,500,808 to two.

The need continues to exist for an even simplier grid structure that permits accurate alignment of the beam-defining apertures in the control grid electrode and those in the screen grid electrode.

SUMMARY OF THE INVENTION

The novel gun comprises, as in prior guns, at least two spaced successive electrodes held in position from a common electrically-insulating support. Each of the electrodes has at least three beam-defining apertures aligned along common axes with beam-defining apertures in the other electrode. One of the electrodes comprises a metal first plate having a plurality of precisely spaced beam-defining first apertures. The other electrode comprises a metal second plate having a plurality of precisely spaced beam-defining second apertures. Unlike prior guns, the common support has a pair of reference apertures therein, and the metal first electrode and the metal second electrode each have two dissimilarly shaped alignment apertures therein. One of the alignment apertures in each of the electrodes is substantially oblong-shaped. The first and second electrodes have two oppositely disposed elongated sides bordering the oblong-shaped apertures. The two sides are mutually aligned with one another. The other alignment aperture in each of the electrodes is substantially triangularly-shaped. The first and second electrodes have three sides bordering the triangularly-shaped apertures. The three sides are mutually aligned with one another. The mutually aligned alignment apertures ensure that the beam-defining first apertures in the first electrode and the beam-defining second apertures in the second electrode are aligned along common axes.

The novel method is similar to prior methods except that instead of placing alignment pins through the beam-defining apertures in the electrodes, specially configured precision alignment pins are used to mutually align non-circular alignment apertures so that the beam-defining apertures in the first and second electrodes are aligned along common axes.

DETAILED DESCRIPTION OF THE PREFERRED EMBODIMENT

Figure 1:
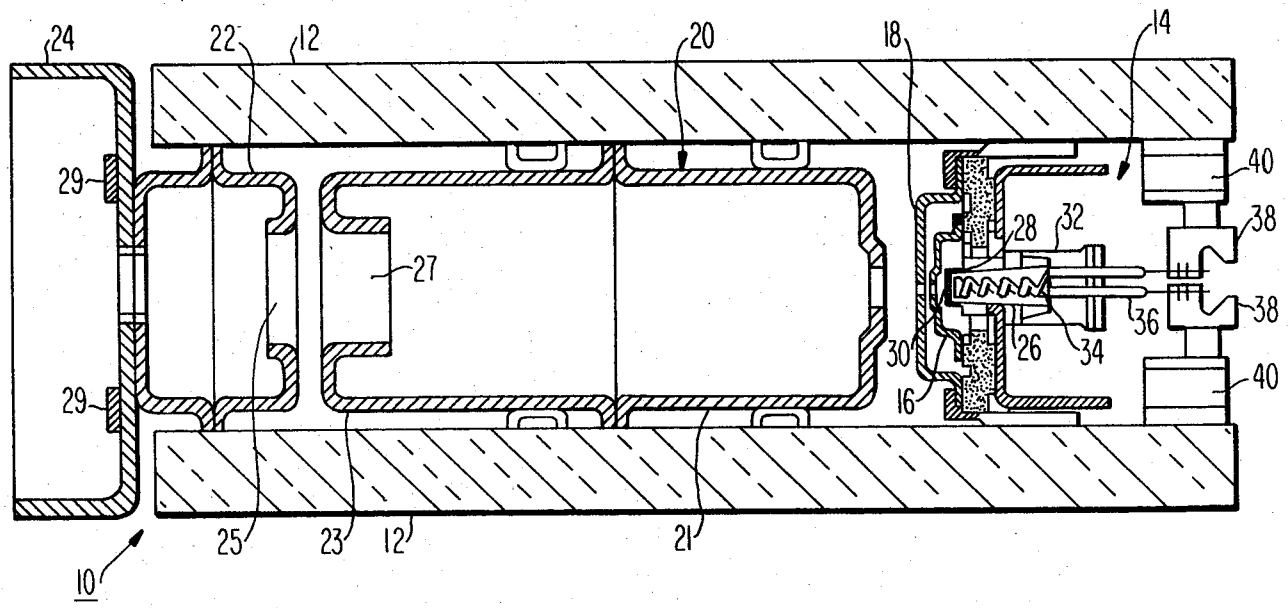
FIG. 1 is a partially cut-away, side elevational view of a preferred embodiment of a novel electron gun.

As shown in FIG. 1, an electron gun 10 comprises two glass support rods 12, also called beads, upon which various electrodes of the gun are mounted. These electrodes include three equally-spaced inline cathode assemblies 14, one for each beam, a control grid electrode 16, a screen grid electrode 18, a first focusing electrode 20, a second focusing electrode 22 and a shield cup 24 spaced from the cathode assemblies 14 in the order named.

The first focusing electrode 20 comprises two rectangularly cup-shaped members 21 and 23 joined together at their open ends. The closed ends of each member 21 and 23 have three apertures, each of which are aligned with the apertures of the control and screen grid electrodes 16 and 18. The second focusing electrode 22 is also rectangularly cup-shaped with the open end of the electrode 22 facing away from the electrode 20. Three in-line apertures also are in the electrode 22. The middle aperture 25 is aligned with the adjacent middle aperture 27 in the first electrode 20. However, the two outer apertures (not shown) are slightly offset outwardly with respect to the outer apertures of the electrode 20 to aid in convergence of the outer beams with the center beam. The shield cup 24, located at the output of the gun 10, has various coma correction members 29 located on its base around or near the electron-beam paths.

Each cathode assembly 14 comprises a cathode sleeve 26 closed at the forward end by a cap 28 having an electron emissive coating 30 thereon. The cathode sleeves 26 are supported at their cpen ends within cathode support tubes 32. Each cathode is indirectly heated by a heater coil 34 positioned within the sleeve 26. The heater coils 34 have legs 36 which are welded to heater straps 38 which, in turn, are welded to support studs 40 that are embedded in the glass rods 12. The control and screen grid electrodes 16 and 18 are two closely-spaced elements Each having three aligned apertures about 0.625 mm (25 mils) in diameter precisely spaced apart about 5.0 mm (200 mils) and centered with the cathode coatings 30.

Figure 2:
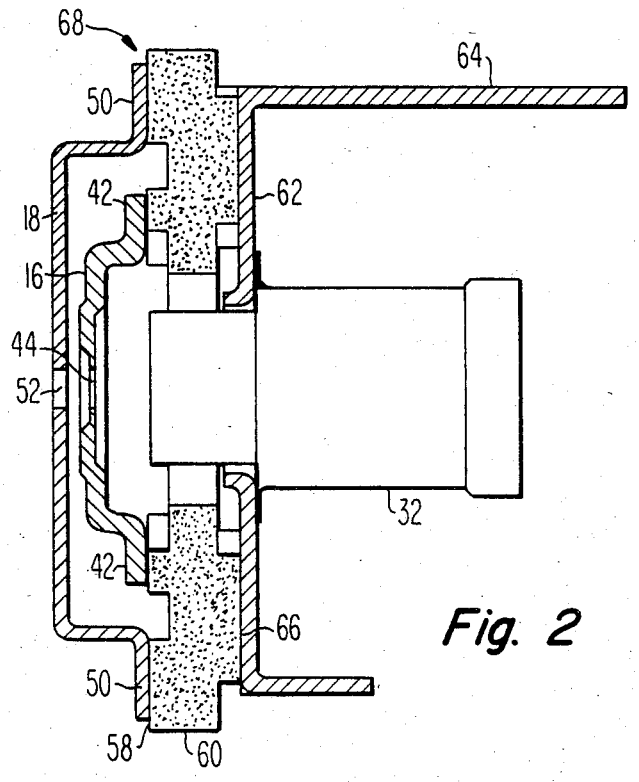
FIG. 2 is a side sectional elevational view of a unitary subassembly following brazing.

As shown in FIG. 2, the control grid electrode 16 is essentially a single flat metal first plate having two parallel flanges 42 on opposite sides of three inline, precisely spaced, beam-defining first apertures 44, only one of which is shown. A pair of dissimilar alignment apertures 46 and 48 (shown in FIG. 4 and described hereinafter) are formed in the control grid electrode 16 outwardly from the beam-defining first apertures 44. The screen grid electrode 18 also is essentially a single flat metal second plate having two parallel flanges 50 on opposite sides of three inline, precisely spaced, beam-defining second apertures 52, only one of which is shown in FIG. 2. A pair of dissimilar alignment apertures 54 and 56 (shown in FIG. 3) are formed in the screen grid electrode 18 outwardly from the beam-defining second apertures 52. The alignment apertures 54 and 56 are substantially identical to the corresponding alignment apertures 46 and 48, respectively, formed in the control grid electrode 16. The control grid electrode 16 and the screen grid electrode 18 are affixed, e.g., by brazing, to one major surface 58 of a common electrically-insulating support 60, which preferably comprises a ceramic member. Three substantially annular members 62, having an integral contact tab 64, are affixed to the other major surface 66 of the common support 60. One of the cathode support tubes 32 is attached to a different one of the annular members 62 to complete a unitary subassembly 68.

Figure 3:
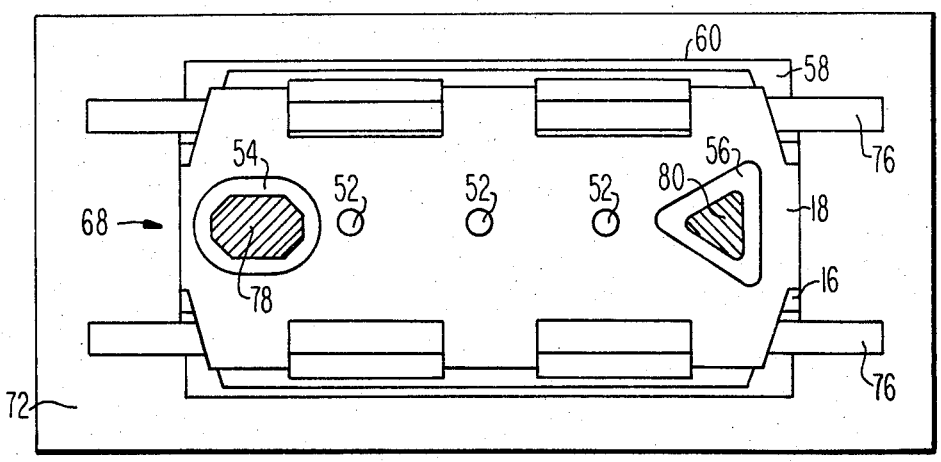
FIG. 3 is a top view of the unitary subassembly stacked on the lower portion of a braze fixture with the alignment pins in the loading position.
Figure 4:
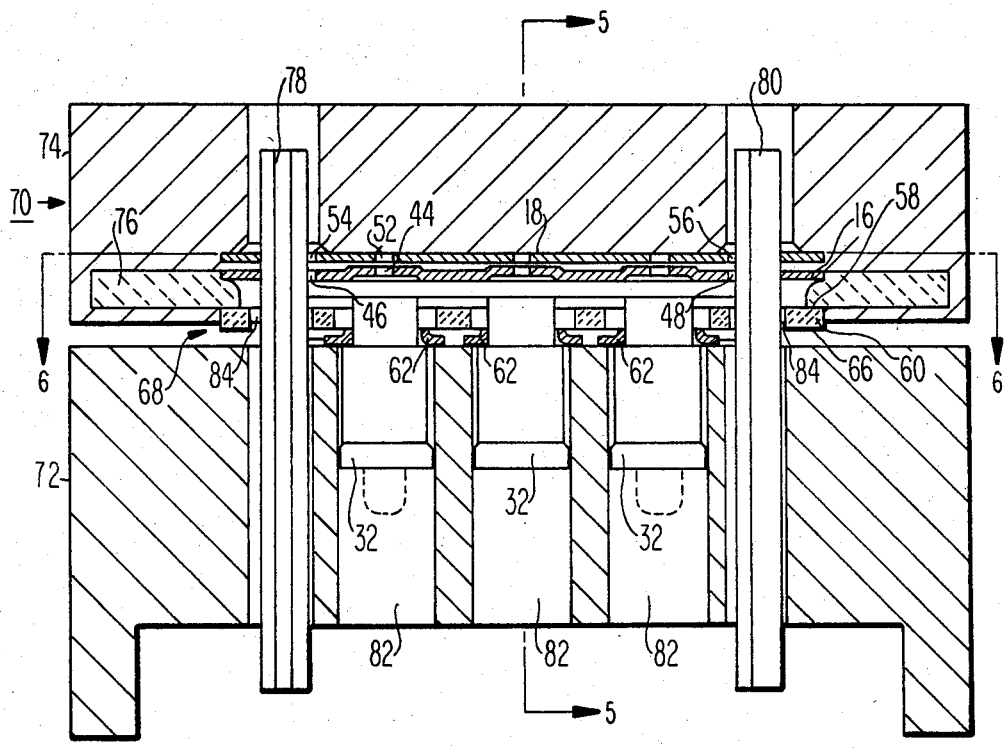
FIGS. 4 and 5 are front and side sectional elevational views of the unitary subassembly during its manufacture.
Figure 5:
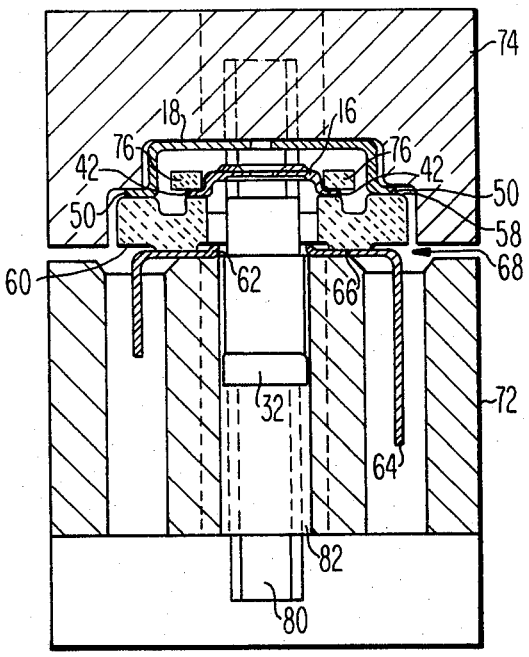

The unitary subassembly 68 is assembled and brazed using a jig 70, shown in FIGS. 3–5. The jig 70 comprises lower and upper jig members 72 and 74, respectively, weights 76 and novel first and second precision alignment pins 78 and 80. As shown in FIG. 3, the first precision alignment pin 78 has a substantially elongated octagonal shape, and the second precision alignment pin 80 has a substantially triangular shape. The octagonally-shaped first pin 78 has an overall length of about 2.25 mm (90 mils) and a maximum width of 1.5 mm (60 mils). The triangularly-shaped second pin 80 can be inscribed wrthin a circle having a diameter of about 2.25 mm (90 mils).

With reference to FIGS. 4 and 5, three cathode support tubes 32 are positioned in three recesses 82 in the lower jig 72. Then, an annular member 62 is positioned on top of each of the support tubes 32. Then, the wafer-shaped common electrically-insulating ceramic support 60 is positioned over the annular members 62. The common support 60 has a hole therethrough opposite each support tube 32 and annular member 62, and a pair of oblong or oval-shaped reference apertures 84 near the ends thereof. The alignment pins 78 and 80 are aligned, as shown in FIG. 3, to facilitate loading of the parts onto the lower jig 72. The pins 78 and 80 are disposed through the reference apertures 84 in the common support 60. The major surfaces 58 and 66 of the common support 60 are selectively metalized so that parts can be brazed thereto. Next, the control grid 16 is positioned so that the substantially oblong or oval-shaped alignment aperture 46 is disposed around the octagonally-shaped alignment pin 78, and the substantially triangularly-shaped alignment aperture 48 is disposed congruently around the triangularly-shaped alignment pin 80 so that the flanges 42 rest on the major surface 58 of the common support 60. The alignment pins 78 and 80 provide about 0.25 mm (10 mils) clearance for the grids 16 and 18 during loading. The weights 76 comprising, e.g., elongated ceramic bars, are disposed on the flanges 42 to facilitate bonding of the control grid to the common support 60. Next, the screen grid 18 is positioned so that the substantially oblong-shaped alignment aperture 54 is disposed around the octagonally-shaped alignment pin 78, and the substantially triangularly-shaped alignment aperture 56 is disposed congruently around the triangularly-shaped alignment pin 80 so that the flanges 50 rest on the major surface 58 of the common support 60. FIG. 3 shows a top view of the unitary subassembly 68 stacked on the lower portion 72 of the jig 70. The beam-defining second apertures 52 of the screen grid 18 and the beam-defining first apertures 44 of the control grid 16, hidden from view by the screen grid 18, are spaced from a reference point within the triangularly-shaped alignment apertures 56 and 48, respectively, to an accuracy of $\pm 0.0038$ mm (0.15 mils). The accuracy of spacing between the aforementioned reference point and the beam-defining apertures in both the control grid 16 and the screen grid 18 is an improvement by a factor of more than two over the precision of manufacturing tolerances discussed in U.S. Pat. No. 4,500,808 referenced above.

Figure 6:
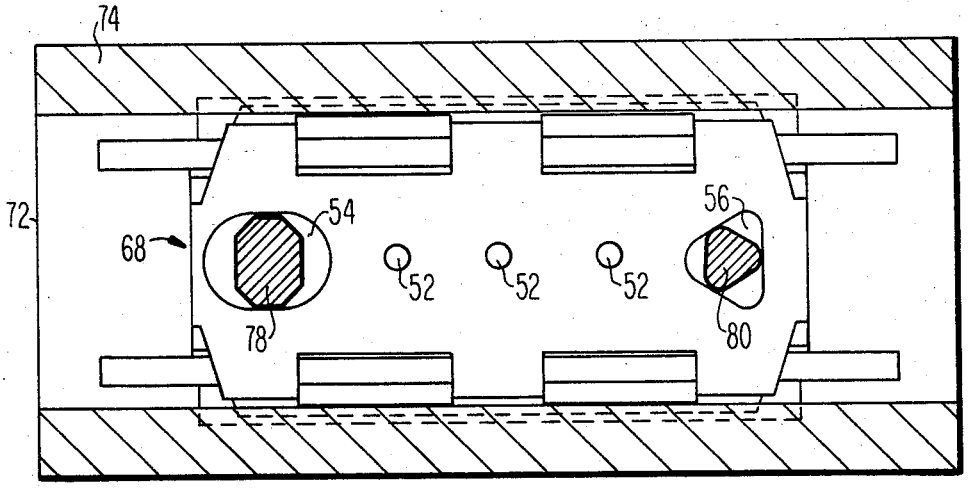
FIG. 6 is a top sectional view taken along lines 6—6 of FIG. 4 showing the unitary subassembly with the alignment pins rotated to provide an interference fit so as to engage the portions of the electrodes around the alignment apertures.

With reference to FIGS. 4–6, the upper jig member 74 is then placed over the lower jig member 72, and the alignment pins 78 and 80 are rotated so as to provide an interfere fit to engage the portion of the control grid 16 and the screen grid 18 bordering the alignment apertures 46 and 48 in the control grid 16 and alignment apertures 54 and 56 in the screen grid 18. The engagement of the alignment pins 78 and 80 serves to slightly reposition the grids 16 and 18 so as to mutually align with one another the two oppositely disposed elongated sides of the grids 16 and 18 bordering the substantially oblong-shaped alignment apertures 46 and 54, and the three sides of the grids 16 and 18 bordering the substantially triangularly-shaped alignment apertures 48 and 56 so that the beam-defining first apertures 44 in the control grid 16 are aligned along common axes with the beam-defining second apertures 52 in the screen grid 18. The novel alignment aperture-alignment pin configurations described herein provide a statically determined positioning of the grids 16 and 18. By this, we mean that the alignment can be accurately reproduced with a three degree of freedom restriction. The unitary subassembly 68 is brazed in a wet hydrogen atmosphere in a BTU three-zone belt furnace at temperatures of 1105° C., 1120° C. and 1105° C. The belt speed through the furnace is four inches per minute.

While described in the embodiment of two successive electrodes attached to the same surface of a common support, it will be clear to one skilled in the art that the alignment structure and method disclosed herein is adaptable for aligning beam-defining apertures in conventional electron guns.

What is claimed is:

1. In a multibeam electron gun comprising at least two spaced successive electrodes, one of said electrodes comprising a metal first plate having at least three precisely spaced beam-defining first apertures therein, the other of said electrodes comprising a metal second plate having at least three precisely spaced beam-defining second apertures, said first plate and said second plate each having two alignment apertures therein, wherein the improvement comprises said two alignment apertures in said first plate and in said second plate being dissimilarly shaped, one of said alignment apertures being substantially oblong-shaped and the other being substantially triangularly-shaped, said first and second plates having two oppositely disposed elongated sides bordering said oblong-shaped apertures which are mutually aligned with one another, said first and second plates also having three sides bordering said substantially triangularly-shaped apertures which are mutually aligned with one another, whereby said beam-defining first apertures in said first plate and said beam-defining second apertures in said second plate are aligned along common axes.

2. In a multibeam electron gun comprising at least two spaced successive electrodes held in position from a common electrically-insulating support, one of said electrodes comprising a metal first plate having at least three precisely spaced beam-defining first apertures therein, the other of said electrodes comprising a metal second plate having at least three precisely spaced beam-defining second apertures, said common electrically-insulating support having a pair of reference apertures therein, said first plate and said second plate each having two alignment apertures therein, wherein the improvement comprises said two alignment apertures in said first plate and in said second plate being dissimilarly shaped, one of said alignment apertures being substantially oblong-shaped and the other being substantially triangularly-shaped, said first and second plates having two oppositely disposed elongated sides bordering said oblong-shaped apertures which are mutually aligned with one another, said first and second plates also having three sides bordering said substantially triangularly-shaped apertures which are mutually aligned with one another, whereby said beam-defining first apertures in said first plate and said beam-defining second apertures in said second plate are aligned along common axes.

3. The electron gun of claim 2, wherein said common electrically-insulating support is a ceramic member having two opposed major surfaces, said ceramic member having at least three openings therein, said openings being aligned along common axes, said metal first plate and said metal second plate being individually attached to the same major surface of said ceramic member.

4. The electron gun of claim 3, including a separate cathode assembly attached to the other major surface of said ceramic member and aligned with each pair of beam-defining first and second apertures.

5. The electron gun of claim 2, wherein said metal first plate is the control grid electrode and the metal second plate is the screen grid electrode.

* * * * *